United States Patent [19]

Menke

[11] 3,947,903

[45] Apr. 6, 1976

[54] FOLDING COUCH FOR BEACH OR CAMPING

[76] Inventor: Hans Reinhard Menke, Marienbader Platz 20, Bad Homburg v.d.h., Germany

[22] Filed: Apr. 19, 1974

[21] Appl. No.: 462,445

[52] U.S. Cl. ..... 5/111; 5/112; 5/116; 190/2; 190/8; 297/17; 297/188

[51] Int. Cl.[2] ..... A47K 11/02

[58] Field of Search ..... 297/16, 17, 184, 188, 190, 297/192, 217, 191, 218, 441, 457; 5/110–112, 116, 308, 324, 320, 343; 190/2, 8; 248/164, 432

[56] References Cited

UNITED STATES PATENTS

| | | | |
|---|---|---|---|
| 1,412,064 | 4/1922 | Sanford | 5/112 |
| 1,541,060 | 6/1925 | Martin | 5/116 UX |
| 3,309,134 | 3/1967 | Roberts | 297/17 |

*Primary Examiner*—James C. Mitchell
*Attorney, Agent, or Firm*—William Frederick Werner

[57] ABSTRACT

There is disclosed an ingenious chair having multiple folding parts including leg portions. The chair has a centrally located portion comprising the seat portion of the chair. U-shaped leg members depend from the ends of the seat portion. Additionally, the ends of the seat portion carrying the leg portions have pivoted therefrom web support means which in effect acts as convenient extensions of the seat portion. The said extensions when folded over the seat portion cover the seat portion which may have placed thereon a plurality of objects. The seat portion having the free ends has extending therefrom additional web material, each of which may be joined together as by a zipper or the like under the seat portion to provide a sling like support means. On the other hand, the two sections of web material may be joined above the top of the seat portion when the two extensions have been folded over the seat. Prior to accomplishing this the seat portion may have placed thereon various articles.

2 Claims, 2 Drawing Figures

FOLDING COUCH FOR BEACH OR CAMPING

BACKGROUND OF THE INVENTION

Folding chairs constructed of tubular support means covered with canvas material or the like are well known. These folding chairs have the virtue of being extremely light to transport. Some of these chairs include merely a seat portion and a back portion which is positioned directly on the sand or ground. Others of a more sophisticated structure are provided with legs so that the user may sit in a more comfortable upright position.

Such lightweight and rather simply constructed folding chairs find wide application at crowded beaches and camp sites as they afford an inexpensive manner of comfortable reclining. The prior art conventional folding, however, have the disadvantage of not possessing any storage facilities such as pockets or pouches to hold small articles that have been brought along to the beach or camp site; not to mention the inability of protecting such articles from theft.

SUMMARY OF THE INVENTION

It is an object of the present invention to overcome at least some of the aforementioned disadvantages and concurrently therewith provide theft-proof locked storage facilities for securing and storing small objects as binoculars, watches, pocket knives, wallets, books, portable radios, cameras, sun glasses, etc., while the owner of such possessions is intermittently away from his chair bathing or walking.

It will be seen that the present invention overcomes some of these inadequacies by providing a constructible centrally located pocket employing the fabric cover of the center portion or seat portion of the chair. The seat portion is provided along two oppositely disposed edges with a fabric extension adapted and constructed whereby the two extensions may be joined together along their free longitudinal edges. They may be joined above the seat or below as desired. When below the extensions provide a sling arrangement for carrying valuables, when above a pocket is thereby formed including the upperside of the seat portion.

The chair may also possess extensions when unfolded laterally enlarges the chair into a couch. The chair may also have depending leg members.

DETAILED DESCRIPTION OF THE INVENTION

Figure 1:
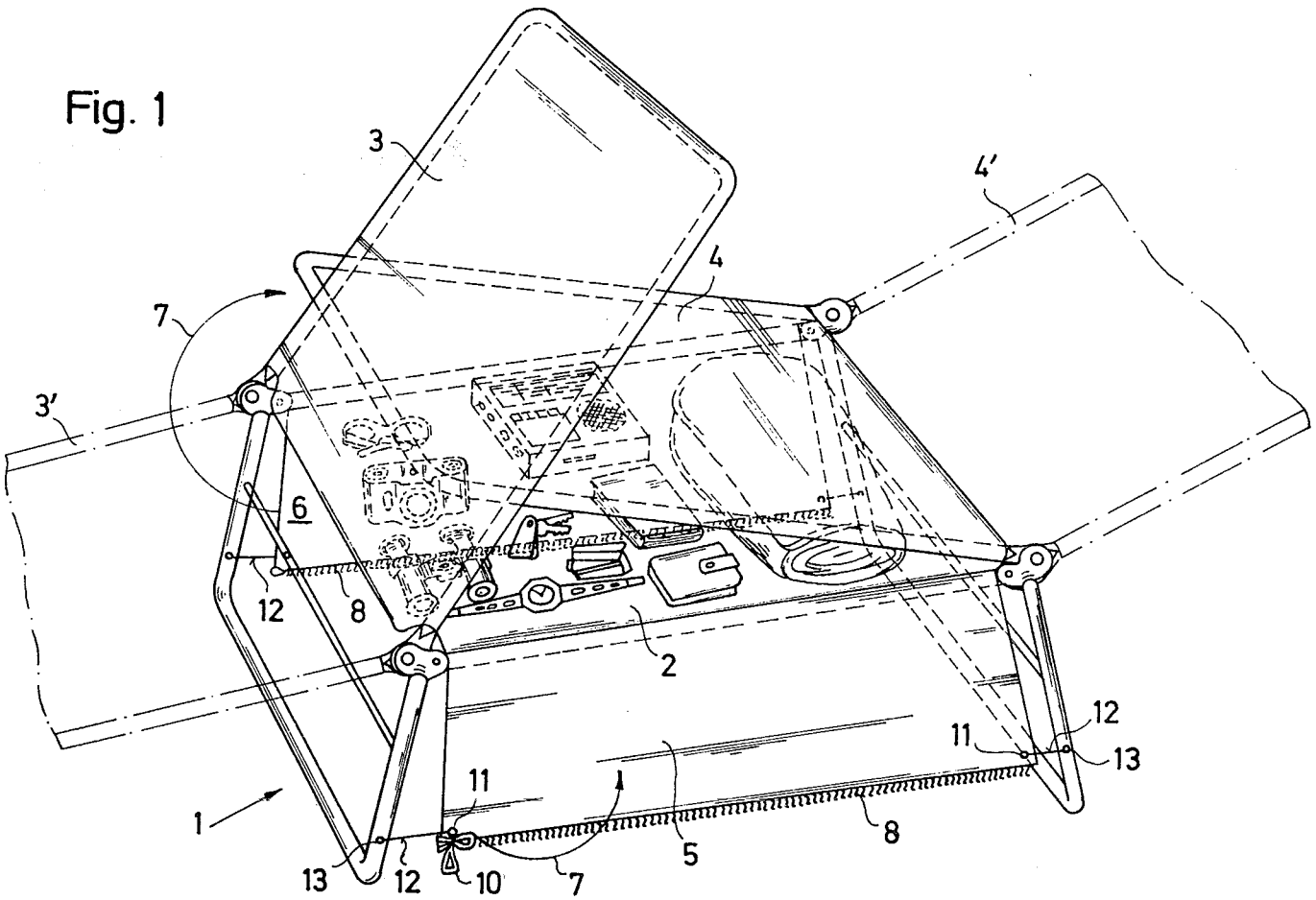
FIG. 1 is a perspective view of the chair of the present invention in a partly folded condition.
Figure 2:
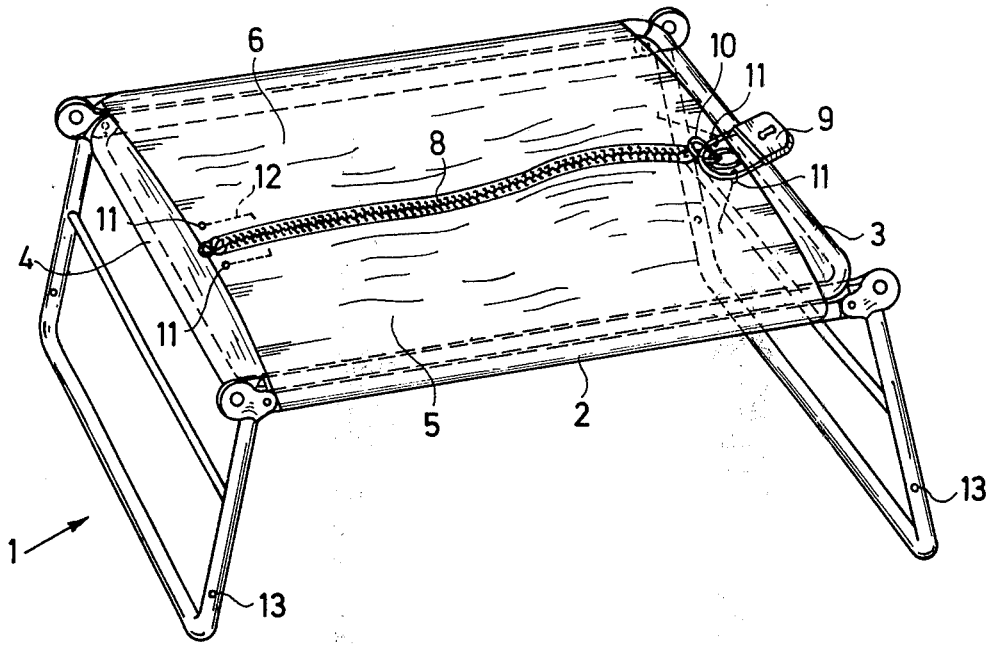
FIG. 2 is a view similar to FIG. 1, depicting the chair in a folded, locked secured position.

Turning now to the drawings, with particular emphasis to FIG. 1, it will be seen that the chair of this invention, includes a center or seat portion 2, a head part 3 and a foot part 4 and two hinged supporting members comprising two U-shaped legs of tubular construction kept rigid by means of conventional stretchers. The seat portion includes two elongated tubular portions which are terminated in a hinge means having a common journalling means for both the mentioned support members but also one of the head or foot parts. The head and foot parts are constructed of tubular U-shaped means, the end portions of the legs thereof are journalled as mentioned whereby they may be folded to overlie the seat portion as illustrated in FIG. 2 or partial unfolding condition as shown in FIG. 1; or as in a virtually completely unfolded condition as shown by dotted lines in the same figure.

The tubular means of the seat portion are connected by a web of fabric. Similarly the U-shaped tubular means of the head and foot part are also joined by fabric. As a matter of fact, the fabric of the mentioned head and foot parts are extensions of the fabric of the seat.

The fabric cover of the seat portion possesses 2 strips of fabric 5 and 6 which extend over the free edges of two longitudinal sides having the tubular means. The strips of fabric 5 and 6 are about one half as large as the seat 2. This arrangement enables the two strips of fabric 5 and 6 to be connected to each other at their free longitudinal sides by means of zipper 8, for instance.

When the chair of the present invention 1 is used in the open position, head and foot parts 3, 4 then assume positions 3′, 4′ depicted by broken line in FIG. 1. The two strips of fabric 5 and 6 may be folded downward and connected with each other under seat portion 2 by means of zipper 8. This creates a hanging pouch or sling below seat portion 2 which is seen to be accessible from both ends. Objects of value which were brought along by the owner of the chair can be stored therein by sliding them in and out of either one of the open ends. Thus, the user of the chair is not compelled to place such objects on the floor or on the sand and is, therefore, able to protect sensitive optical and electrical items from dirt and grime.

The strips of fabric 5 and 6 may also be arranged in a vertical downward draped position, to be easily fastened to and removed from the hinged supporting leg members by means of hooks 12. This facilitates the storage of larger objects, such as food, beverages, items of clothing or blankets under seat portion 2 in a shaded and wind-protected location. The strips of fabric 5 and 6 and the hinged supporting leg members are provided with suitable perforations 11 and 13 to facilitate insertion of the hooks 12.

The greatest advantage of the strips of fabric 5 and 6, however, is the fact that they can be connected to each other with zipper 8, and locked, after valuables are deposited on fabric covered seat portion 2, after the head and foot parts 3 and 4 have been folded up in the direction of arrows 7, thereby protecting items from theft.

If, as shown in FIG. 2, flat seat portion 2, with head and foot parts 3 and 4 superimposed on top, is covered by the strips of fabric 5 and 6, connected with each other, and a padlock is inserted through zipper eye 10 and through one or both of adjacent perforations 11 of the strips of fabric 5 and 6, a relatively pilferproof arrangement will be formed which the user of the chair may leave without undue concern as to the safety of his possessions. Individual objects which might be especially attractive to a thief cannot be removed. The thief would have to pick up and remove the entire locked chair which would be an obvious and risky undertaking as other people in the immediate and even remote vicinity would recognize the chair and know its rightful owner.

The folding chair of the invention thus achieves its objectives in a very economic manner as additionally the use of the strips of fabric 5 and 6 and zipper 8 affords a minimum as regards expense and operation and yet is ingenious.

What is claimed is:

1. A folding couch comprising two elongated tubular portions, a head part comprising a first U-shaped tubular member having open ends, a first hinge means pivotally connecting the open ends of said first U-shaped tubular member to said two elongated tubular portions, respectively, a foot part comprising a second U-shaped tubular member, a second hinge means pivotally connecting the open ends of said second U-shaped tubular member to said two elongated tubular portions, respectively, a web covering said two elongated tubular portions and having two flaps extending on opposite sides a distance equal to half the distance between said two elongated tubular portions, said web extending the length and width of said head part and said foot part, means fastening said web to said two elongated tubular portions and to said head part and said foot part, zipper means fastened to said two flaps, said head part and said foot part pivotally hinged one part over the other part to form the closed ends of a pouch and to be overlain by said two flaps, said zipper closing said two flaps to form a closed pouch, and means to lock said zipper in closed pouch position.

2. The folding couch of claim 1 wherein there is provided, a head part U-shaped supporting leg having open ends, means pivotally connecting said open ends to said first hinge means, and a foot part U-shaped supporting leg having open ends, means pivotally connecting said open ends to said second hinge means.

* * * * *